United States Patent [19]

Ueda et al.

[11] 4,009,081

[45] Feb. 22, 1977

[54] DUST ARRESTING APPARATUS FOR A COKE DRY QUENCHING STATION

[75] Inventors: Takeshi Ueda; Kunihei Koizumi, both of Yokohama; Tatsu Otani, Yokosuka; Shun-ichi Hironaka, Yokohama, all of Japan

[73] Assignee: Nippon Kokan Kabushiki Kaisha, Tokyo, Japan

[22] Filed: Nov. 21, 1975

[21] Appl. No.: 634,324

[30] Foreign Application Priority Data

Nov. 27, 1974 Japan ..... 49-135598

[52] U.S. Cl. ..... 202/227; 202/251; 202/262; 202/263; 214/18 PH; 214/17 C; 214/35 R; 212/4; 110/108; 214/17 B

[51] Int. Cl.[2] ..... C10B 31/02

[58] Field of Search ..... 202/227, 228, 251, 262, 202/263; 214/18 PH, 17 B, 17 C, 35 R; 212/4; 110/108

[56] References Cited

UNITED STATES PATENTS

| | | | |
|---|---|---|---|
| 1,098,374 | 6/1914 | Feicks | 214/18 PH UX |
| 3,536,205 | 10/1970 | Bender | 202/262 X |
| 3,716,150 | 2/1973 | Echterhoff et al. | 202/263 |
| 3,774,787 | 11/1973 | Ledinsky | 202/262 X |
| R16,685 | 7/1927 | McGregor | 214/18 PH |

*Primary Examiner*—James H. Tayman, Jr.

[57] ABSTRACT

An apparatus for arresting the generation of dust from a coke dry quenching station comprising a dust collecting hood mounted on a traveling crane for transferring to the coke dry quenching station a coke bucket loaded with coke discharged from a coke oven so that the upper surface and the outer side wall of the bucket are enclosed by the dust collecting hood when the bucket is suspended from the crane, a fixed hood permanently arranged above the coke charging hole in the top of the quenching station in such a manner that the upper edge portion of the fixed hood is located adjacent to the lower edge portion of the dust collecting hood to form a practically continued hood, a suction duct attached to the fixed hood at its one end and connected to a dust collector at its other end, a movable chute disposed below the fixed hood so that it alternately changes positions with a lid which closes the coke charging hole of the quenching station, and a flange portion formed on the lower edge portion of the chute and adapted so that when the bucket is lowered the peripheral edge portion of the flange portion is received in the annular groove which is formed in the quenching station top around the coke charging hole and which is filled with water, the movable chute being adapted so that the movable chute is lowered by the weight of the bucket by an amount equal to the amount of the engagement of the peripheral edge portion in the annular groove, whereby the generation of dust during the coke charging operation is arrested.

3 Claims, 5 Drawing Figures

DUST ARRESTING APPARATUS FOR A COKE DRY QUENCHING STATION

BACKGROUND OF THE INVENTION

The present invention relates to a dust arresting apparatus for a coke dry quenching station which is capable of preventing the generation of dust during the charging of carbonized coke into a dry quenching station.

In a known type of coke dry quenching station, the carbonized coke discharged from a coke oven is transferred to a coke bucket which is in turn carried by a carriage to a position near the quenching station, where the coke bucket is lifted, moved to a position above the top of the quenching station and placed on the rest on the top of the quenching station. The discharging flap in the lower portion of the bucket is then opened and at the same time the lid which has closed the charging hole in the top of the quenching station is opened, a movable chute is positioned in place to enclose the lower edge portion of the coke bucket and the top charging hole and thereby to reduce the generation of dust during the charging of the coke into the quenching station. A disadvantage of this arrangement is that since the chute is designed so that it is moved into the space in place of the lid and consequently there is inevitably a clearance between the lower edge portion of the coke bucket and the top portion of the quenching station around the coke charging hole due to the mechanical restrictions, a large amount of dust is generated through the clearance each time the coke is charged into the quenching station and therefore the occurrence of a considerable amount of black smoke upon charging of the coke into the quenching station is unavoidable due to the combined effect of the dust and the high temperature ascending air stream from within the quenching station.

SUMMARY OF THE INVENTION

With a view to overcoming the foregoing deficiency, it is an object of the present invention to provide an apparatus for arresting the generation of dust which is so designed that the dust generated upon charging the coke from a coke bucket into a dry quenching station is effectively caught and there is no obstacle for the opening and closing of the lid for the quenching station top and the movement of a movable chute.

In accordance with the present invention, there is thus provided a dust arresting apparatus for a coke dry quenching station comprising a dust collecting hood mounted on a traveling crane for transferring to the dry quenching station a conveying coke bucket loaded with the coke discharged from a coke oven so that the upper surface and the outer side wall of the bucket are enclosed by the dust collecting hood when the bucket is suspended from the crane, a fixed hood permanently arranged above the coke charging hole in the top of the dry quenching station in such a manner that the upper edge portion of the fixed hood is positioned adjacent to the lower edge portion of the dust collecting hood to form a practically continued hood, a suction duct attached to the fixed hood at its one end and connected to a dust collector at its other end, a movable chute disposed below the fixed hood and adapted to alternately change positions with a lid which closes the coke charging hole of the dry quenching station, and a flange portion provided on the lower edge portion of the chute and adapted so that when the bucket is lowered the peripheral edge portion of the flange portion is received in the annular groove formed in the quenching station top around the coke charging hole and which is filled with water, the movable chute being adapted so that the chute is lowered by the weight of the bucket by an amount equal to the amount of the engagement of the peripheral edge portion in the annular groove, whereby the dispersion of black smoke and dust during the charging of the coke into the quenching station is arrested.

BRIEF DESCRIPTION OF THE DRAWING

The various features and advantages of the present invention will become more clearly apparent from the following detailed description thereof which is to be read with reference to the accompanying drawings in which.

DESCRIPTION OF THE PREFERRED EMBODIMENT

Figure 2:
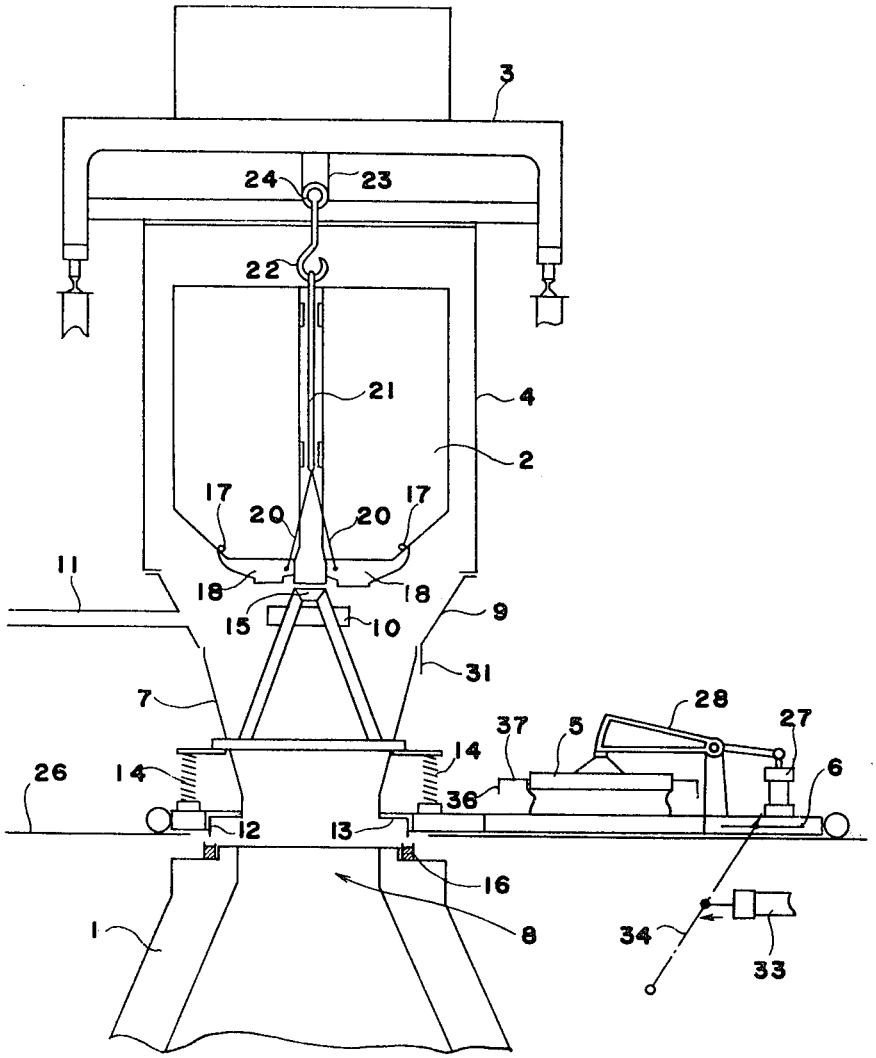
FIG. 2 is a sectional view similar to FIG. 1, showing the apparatus in which the coke charging hole has been opened and the movable chute has been placed over the coke charging hole.
Figure 3:
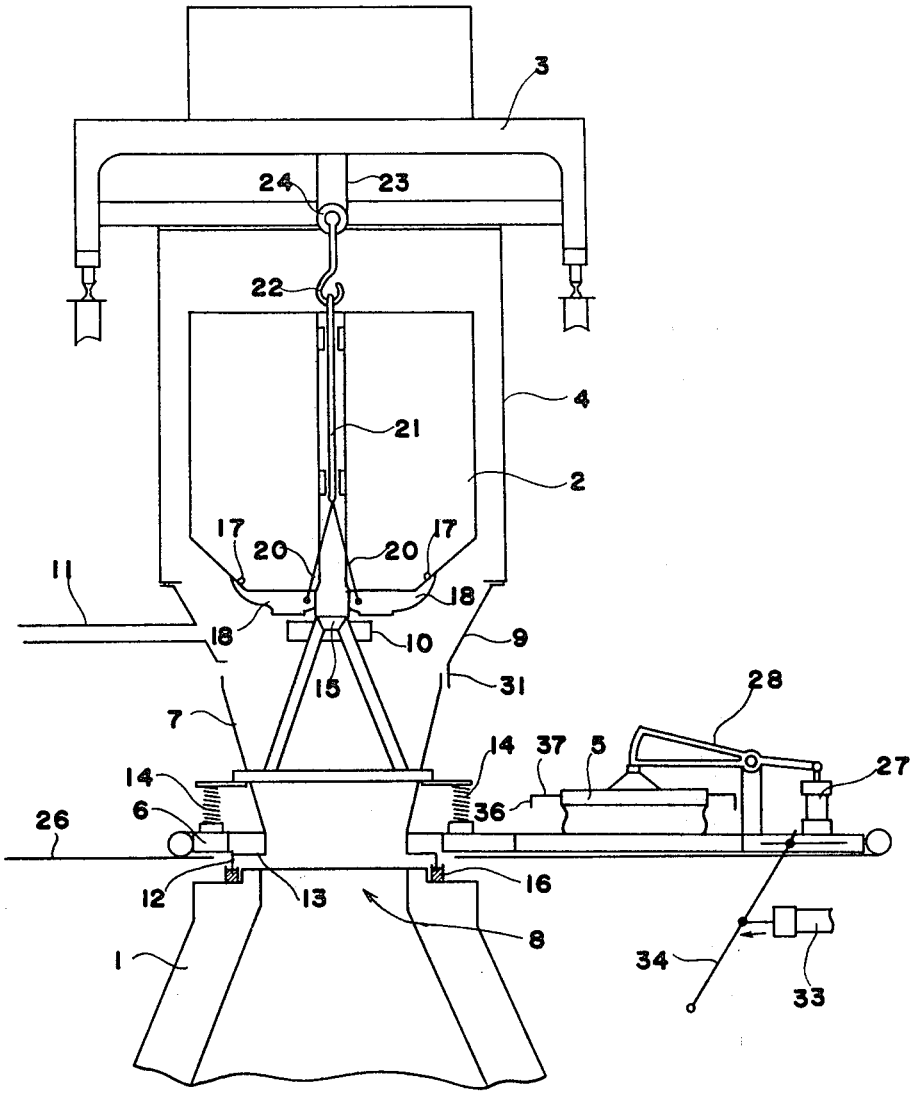
FIG. 3 is a sectional view similar to FIG. 1, showing the manner in which the chute is lowered by the lowering of the bucket.
Figure 4:
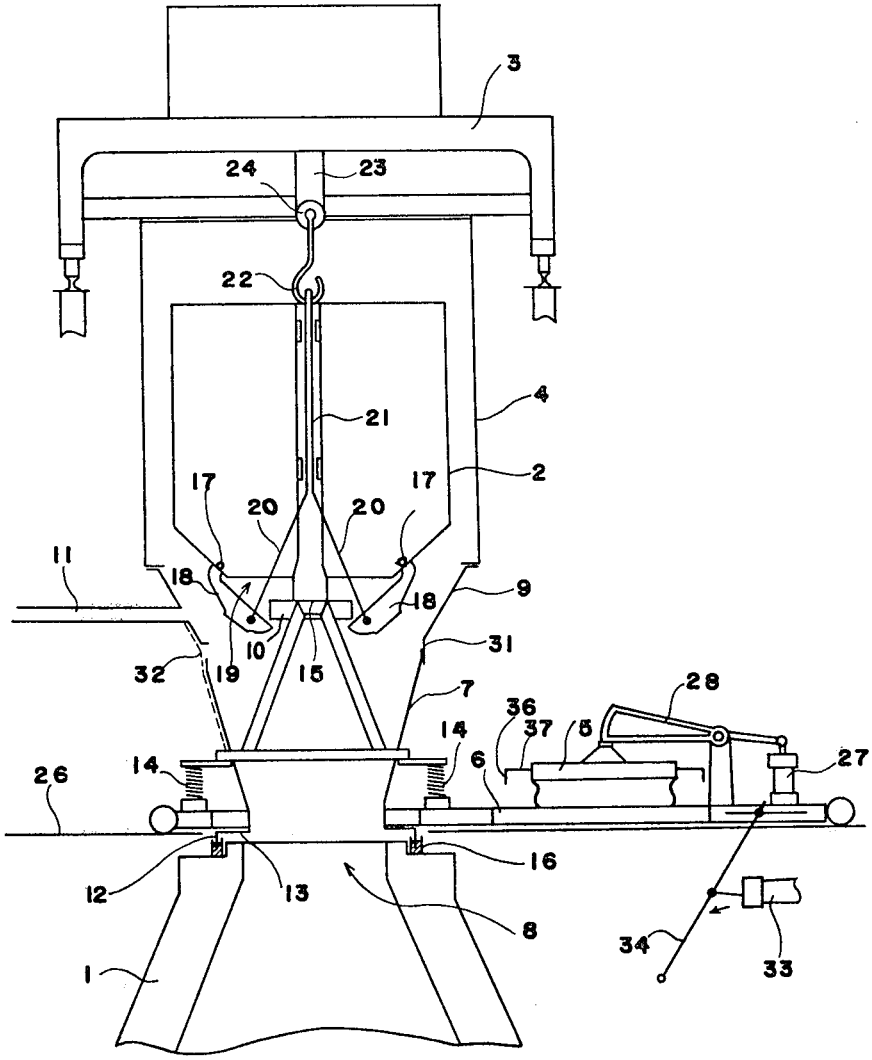
FIG. 4 is a sectional view similar to FIG. 1, showing the apparatus in which the bucket has lowered further from the position of FIG. 3 with the coke discharging flap at the bottom thereof opened.

Referring to FIGS. 1 through 5, numeral 1 designates the top portion of a coke dry quenching station for quenching carbonized hot coke, 2 a coke bucket for conveying the hot coke from the coke side of a coke oven to the quenching station including at the bottom thereof bottom flaps 18 each attached to the bottom for rotation about a hinge 17 serving as a fulcrum therefor so that when the bottom flap 18 are opened the hot coke loaded in the coke bucket 2 is dropped and discharged through the opening at the bottom of a coke discharging hole 19 (FIG. 4). The coke bucket 2 which has been loaded with the hot coke is normally carried to a point on the transport path to the quenching station by a self-propelled car or a car pulled by an electric locomotive and it is then lifted and moved to a position just above the quenching station by a traveling crane 3 which travels on the elevated girders. In this case, during the time that the bucket 2 is rested on the car, the bottom flaps 18 are held closed by virtue of the fact that the bucket 2 rests, whereas when the bucket 2 is suspended from the traveling crane 3 the bottom flaps 18 are held in closed position by virtue of the fact that a wire 20 and a slide bar 21 are pulled by a hook 22 of the crane 3.

A dust collecting hood 4 is fixedly mounted on the traveling crane 3 so that the upper surface and outer side wall of the bucket 2 are enclosed by the dust collecting hood 4 when the bucket 2 is suspended from the crane 3. Of course, the dust collecting hood 4 is provided at the upper surface thereof with an opening for receiving a wire 23 and a pulley 24 which raises and lowers the hook 22. As a result, with the coke bucket 2 accommodated in the hood 4 and suspended from the traveling crane 3, the traveling crane 3 can travel.

On the other hand, fixedly mounted in the top portion of the dry quenching station 1 is a pair of rests 10 supported by props 25 for holding the coke bucket 2, and a fixed hood 9 is fixedly mounted on the props 25 in such a manner that the lower edge portion of the dust collecting hood 4 mounted on the crane 3 is positioned close to the upper edge portion of the fixed hood 9. A suction duct 11 connected to a dust collector (not shown) is connected to the fixed hood 9 so that the dust generated within the fixed hood 9 is sucked through the suction pipe 11. The height of the upper edge portion of the fixed hood 9 is selected so that when the crane 3 is positioned just above the top of the quenching station 1 the upper edge portion of the fixed hood 9 practically contacts the lower edge portion of the dust collecting hood 4 leaving only a small clearance therebetween. For example, fine adjustment means, e.g., an air cylinder unit may be used to vertically move with a slight stroke the dust collecting hood 4 on the crane 3 so that the hoods 4 and 9 are practically brought into contact with each other to form a continuous hood. It is needless to say that the presence of the clearance between the hoods 4 and 9 is necessary only for the purpose of reducing the pressure in the space defined by the hoods 4 and 9 to a level lower than that of the external atmospheric pressure by the sucking of the air through the suction duct 11 and therefore it is only necessary to design the height of the fixed hood 9 so that it has a suitable dimension in relation to the capacity of the associated dust collector.

In the top section of the quenching station below the fixed hood 9 a carriage 6 is movably arranged on rails 26 and the carriage 6 includes a top lid 5 for closing a coke charging hole 8 of the quenching station 1 and a movable chute 7 which serves as a chute during the charging of coke. In this way, the top lid 5 and the movable chute 7 may be alternately positioned over the coke charging hole 8 in accordance with the movement of the carriage 6.

Figure 1:
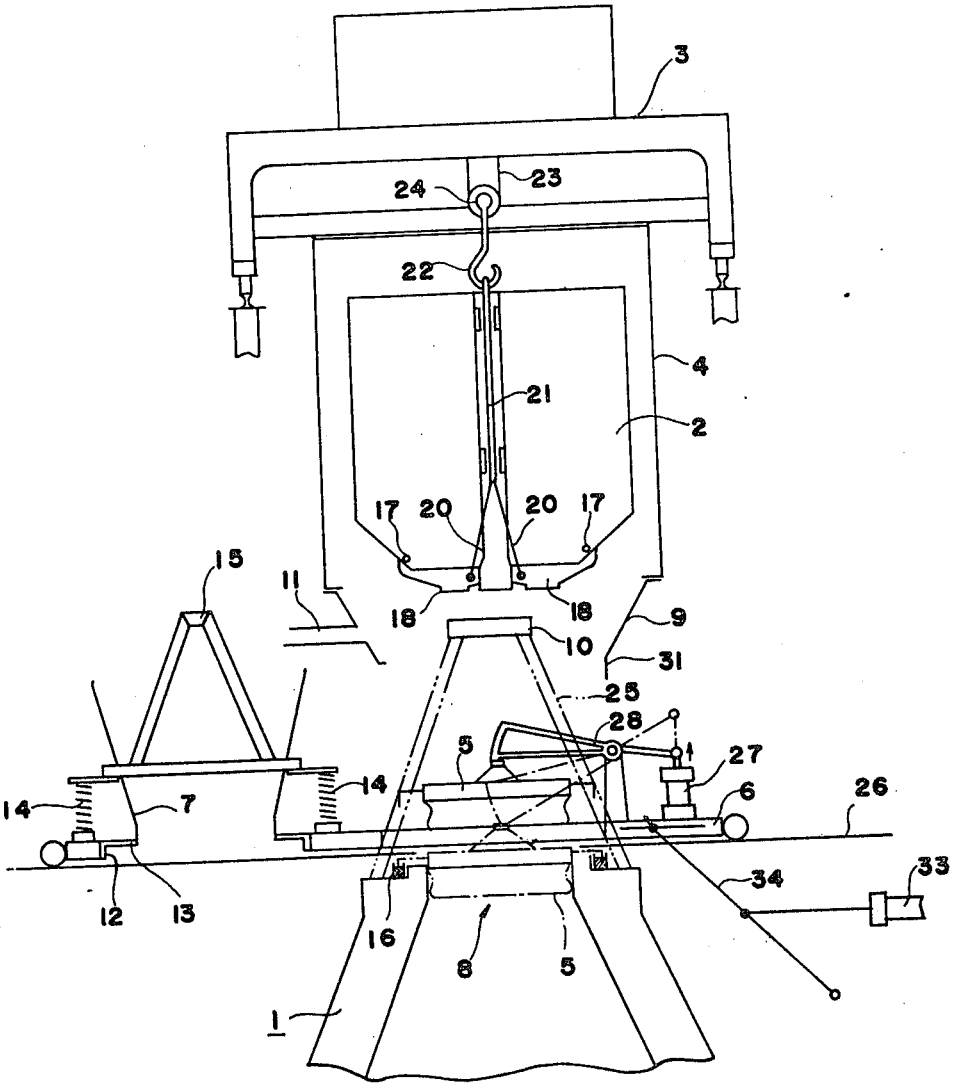
FIG. 1 is a schematic sectional view of a dust arresting apparatus in accordance with an embodiment of the invention, showing the manner in which the coke charging hole in the top of a dry quenching station which has been closed by the lid is opened.

As shown in FIG. 1, the top lid 5 is mounted on the carriage 6 so that it is vertically movable in accordance with the movement of the piston rod of a cylinder unit 27 through a link 28. Thus, when the top lid 5 is raised to open the coke charging hole 8, the top lid 5 is lifted to a position which allows travel of the carriage 6 without any contact therewith.

In this embodiment, the movable chute 7 which is provided on the carriage 6 is supported on springs 14 so that as shown in FIGS. 1 and 2 the movable chute 7 is raised by the spring force of the springs 14 to a position which does not impede the traveling movement of the carriage 6 as is the case when the top lid 5 is raised. A pair of saddles 15 are fixedly secured to the movable chute 7 so that the chute 7 is forced downward against the springs 14 prior to the positioning of the bucket 2 on the rests 10 during the lowering of the bucket 2, and the height of the saddles 15 is selected in such a manner that when the chute 7 is in its raised position it is located above the rests 10 as best shown in FIG. 2.

The movable chute 7 is provided at the lower end thereof with a flange portion 13 having a downwardly extended peripheral wall 12 so that when the chute 7 is forced downwardly, the lower end of the peripheral wall 12 is received in an annular groove 16 which is formed in the quenching station top around the coke charging hole 8 thereby providing a water seal.

Figure 5:
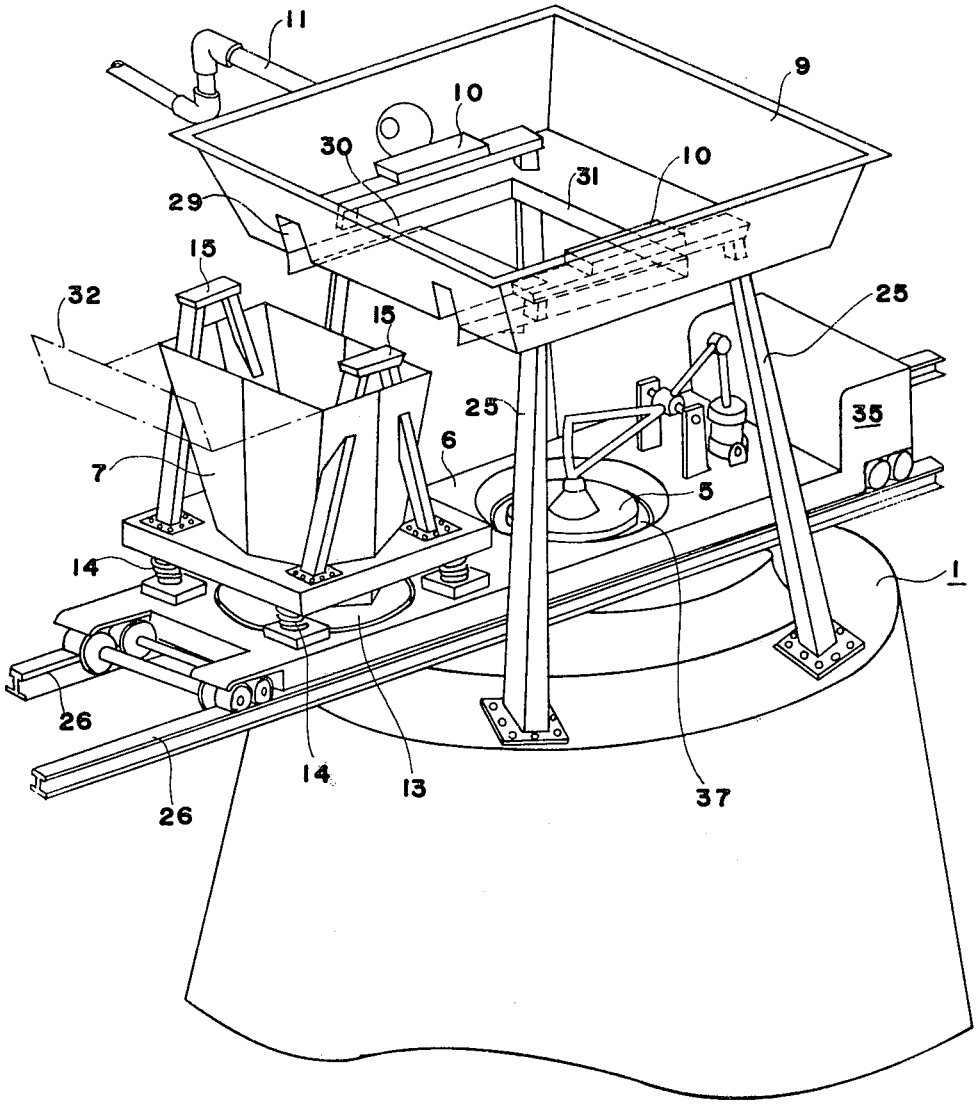
FIG. 5 is a perspective view showing in detail the construction of the quenching station top constituting part of the apparatus according to the invention.

The height of the upper edge portion of the movable chute 7 is selected so that the movable chute 7 is movable in its raised position into a position below the fixed hood 9 and in the illustrated embodiment the fixed hood 9 is provided in one side thereof with a pair of openings 29 for permitting entry of the saddles 15 and a pair of slits 30 opened in the projected sides of the fixed hood 9 for the same purposes as shown in FIG. 5. There is possibility that the vacuum developed in the space defined by the hoods 4 and 9 by the sucking of the air through the suction duct 11 may be nullified by the openings 29 and the slits 30 as well as the clearance formed between the projected sides of the fixed hood 9 and the movable chute 17 when the latter is forced downward. Therefore, in the illustrated embodiment, as shown in FIG. 5, the fixed hood 9 is provided with a wall portion 31 so that the peripheral portion of the bottom opening in the fixed hood 9 and the upper edge portion of the movable chute 7 overlap each other in such a manner that the movement of the movable chute 7 into and away from the position below the fixed hood 9 is not obstructed and the movable chute 7 is also provided with a sealing cover 32. Instead of using the sealing cover 32, the carriage 6 may be provided with a fixed double jacket which is not vertically movable so that the movable chute 7 alone is forced downward within the jacket.

While driving means for causing the carriage 6 to travel may comprise, as schematically shown in FIGS. 1 through 4, a cylinder unit 33 which reciprocates the carriage 6 through a link mechanism 34, as shown in FIG. 5, the carriage 6 may be equipped with a driving motor 35 which in turn may be controlled remotely.

On the other hand, in addition to the water seal structure provided by the annular groove 16, as shown in the drawings, the top lid 5 may be provided with a flange 37 having a downwardly projected peripheral wall 36 to provide a water seal structure for the top lid 5 to thereby prevent the escape of dust which might otherwise leak out through the clearance between the coke charging hole 8 and the top lid 5.

With the construction described above, the operation of the dust arresting apparatus according to the present invention is as follows. As shown in FIG. 1, the coke bucket 2 which has been lifted by the crane 3 from a traveling car in front of the quenching station is received in the dust collecting hood 4 mounted on the crane 3 and it is then moved to a position above the top of the quenching station 1 where the lower edge portion of the dust collecting hood 4 is brought near to or into contact with the upper edge portion of the fixed hood 9 to join the hoods 4 and 9 as a continuous unitary hood. Then, prior to the opening of the flap in the lower portion of the bucket 2, the top lid 5 is opened by means of the cylinder unit 27 and the carriage 6 is moved to bring the movable chute 7 below the fixed hood 9 and position it in place above the top coke charging hole 8 as shown in FIG. 2.

When this occurs, as shown in FIG. 3, while the dust collector connected to the suction duct 11 attached to the fixed hood 9 is operated, the hood 22 of the crane 3 is lowered to gradually lower the bucket 2 so that the saddles 15 are first depressed by the bucket 2 as shown in FIG. 3 to force the movable chute 7 downwardly and consequently cause lower end of the peripheral wall 12 to gradually enter by the annular groove 16. When the bucket 2 is lowered further by the operation of the crane 3, the movable chute 7 is depressed further so that a water seal is provided by the peripheral wall 12 and the annular groove 16 and at the same time the bucket 2 is positioned in place on the rests 10. Further lowering of the hook 22 causes the slide bar 21 to fall and slacken the wire 20. Consequently, the bottom flaps 18 on the bottom of the bucket 2 are opened and thus the coke is charged into the quenching station 1 through the coke charging hole 8 by way of a series of closed spaces defined by the dust collecting hood 4, the fixed hood 9 and the movable chute 7. Of course, the dust collector is kept in operation during this time interval thus continuously attracting the dust raised during the charging of the coke and in this way the dust is effectively prevented from scattering to the outside.

The load for the above-mentioned depression of the movable chute 7 may be easily provided by altering the lifting conditions of the crane 3 and any interference between the top of the quenching station 1 and the lower end of the movable chute 7 may be eliminated by properly designing the stroke of the springs 14 and the dimension of the peripheral wall 12, for example, thereby allowing the carriage 6 to move freely without any obstruction.

Further, by designing those portions of the fixed hood 9 and the movable chute 7, which do not interfere with one another during the movement of the latter into the position below the fixed hood 9, so that they may overlap one another and by carefully determining the dimension of the respective parts in relation to the amount of depression, the amount of clearance which might be caused between the lower edge portion of the fixed hood 9 and the upper edge portion of the movable chute 7 during the above-mentioned forced downward movement of the movable chute 7 may be reduced to such an extent that the negative pressure developed by the suction of the air through the suction duct 11 in the space defined by each hood is maintained at a predetermined value. This may be designed in many different ways in relation to the capacity of the dust collector. Furthermore, while the vertical movement of the movable chute 7 is effected by means of the springs 14, it is of course possible to accomplish this by any other means such as cylinders, link mechanisms or the like.

It will thus be seen from the foregoing description that in accordance with the present invention, irrespective of whether the quenching stations are new and old, the generation of dust caused during the charging of coke into the quenching station may be effectively prevented with a simple arrangement and moreover there is no danger of causing any obstacle to the movement of the top lid and the movable chute, thereby contributing greatly toward the maintenance of a good working environment with prevention of environmental pollution.

We claim:

1. In a coke dry quenching installation including a traveling crane for moving a coke bucket which is loaded with hot coke from a coke oven to a position above the top of a dry quenching station, the provision of a dust arresting apparatus comprising: a first hood permanently mounted on said traveling crane to enclose an upper surface and an outer side wall of said coke bucket when said coke bucket is suspended from said traveling crane; rest means fixedly mounted above a coke charging hole provided at the top of said dry quenching station for holding said coke bucket suspended from said traveling crane to charge the hot coke in said bucket into said quenching station; a second hood fixedly mounted together with said rest means to enclose said rest means and adapted to form a unitary hood together with said first hood when said coke bucket is positioned in place on said rest means by said traveling crane, the lower edge portion of said first hood being then positioned close to the upper edge portion of said second hood; a duct connected to said second hood for connecting the interior of said second hood to a suction port of a dust collecting means; a traveling carriage mounted above said coke charging hole and including a top lid for closing the coke charging hole of said dry quenching station, and a chute, said carriage being displaceable to place said chute above said coke charging hole in alignment with said second hood, means for opening and closing said top lid, said top lid being raisable in its open position to a level above the top of the station to permit travel of said carriage; elastic means for urging the lower end of said chute to a position above the top of the station to permit travel of the carriage when the weight of said coke bucket is not applied on said chute; a flange having a downwardly extended peripheral wall at the lower end of said chute; and means for lowering said chute in response to the weight of said coke bucket comprising a pair of saddles mounted on said movable chute to normally occupy a position above said rest means such that when the coke bucket is lowered it rests on said saddles and lowers said chute against the action of the elastic means, an annular groove being provided in said top around said coke charging hole and containing water, said annular groove being positioned to receive said peripheral wall of said flange to provide a water seal when said chute is lowered.

2. An apparatus according to claim 1, wherein said second hood has a peripheral wall formed around an opening in the lower portion thereof, said peripheral wall being adapted to overlap the upper edge portion of said movable chute.

3. An apparatus according to claim 2, wherein said movable chute includes an outer cover for enclosing a clearance between said movable chute and said second hood.

* * * * *